US009861847B2

(12) United States Patent
McLoughlin

(10) Patent No.: US 9,861,847 B2
(45) Date of Patent: Jan. 9, 2018

(54) FIRE TRUCK HOSE BED COVER AND PERSONNEL SAFETY BARRIER

(71) Applicant: John E. McLoughlin, Hauppauge, NY (US)

(72) Inventor: John E. McLoughlin, Hauppauge, NY (US)

( * ) Notice: Subject to any disclaimer, the term of this patent is extended or adjusted under 35 U.S.C. 154(b) by 126 days.

(21) Appl. No.: 14/931,839

(22) Filed: Nov. 3, 2015

(65) Prior Publication Data

US 2017/0120834 A1 May 4, 2017

(51) Int. Cl.
*A62C 27/00* (2006.01)

(52) U.S. Cl.
CPC ..... *A62C 27/00* (2013.01)

(58) Field of Classification Search
CPC ..... B60R 11/06; B60R 9/055; B60J 7/1291; A62C 27/00
See application file for complete search history.

(56) References Cited

U.S. PATENT DOCUMENTS 6,106,050 A * 8/2000 McLeod ..... B62D 33/0273 296/100.06
2004/0160083 A1* 8/2004 Marx ..... B60J 7/141 296/100.09
2015/0273253 A1* 10/2015 Lenz, Jr. ..... A62C 27/00 280/4

OTHER PUBLICATIONS

"Central Fire Santa Cruz E3412," Burton's Fire, Inc., http://burtonfire.com/oldsite/refurbish_central_santa_cruz.htm, downloaded Nov. 19, 2015, 4 pages.
"Fire Hose Bed Covers," Dynatect Manufacturing Inc., http://www.dynatect.com/protective-covers/aluminum-roll-up-doors/hose-bed-covers, downloaded Nov. 19, 2015, 3 pages.
"Hose Bed Cover," Firl Industries, Inc., http://www.firlindustries.com/hose_bed.html, downloaded Nov. 19, 2015, 1 page.
"Hose Bed Covers," 4 Guys, Inc., http://www.4guysfire.com/features-hosebedcover.htm, downloaded Nov. 19, 2015, 1 page.
Petrillo, Alan M., "Special Delivery: Rural Department Chooses UST for Rescue-Pumper," Fire Apparatus and Emergency Equipment, Oct. 2, 2013, 6 pages.
Shand, Tom, "Innovative Rigs on the Street: Sperryville's Attack Unit," Firehouse, Sep. 3, 2010, 7 pages.
Vaccaro, Bob, "Securing the hose," FireRescue1, Jan. 3, 2007, 3 pages.

* cited by examiner

*Primary Examiner* — Pinel E Romain
(74) *Attorney, Agent, or Firm* — Wei Wei Jeang; Grable Martin Fulton PLLC

(57) ABSTRACT

A cover and personnel safety barrier for a fire truck hose bed comprises left and right door panels each coupled to the hose bed by at least one rotatable connector and configured to cover openings to the hose bed in the closed position, left and right locking retractable reels coupled to the left and right door panels, respectively, and a cable connecting the left and right locking retractable reels coupled to the left and right door panels to form a safety barrier over the hose bed when the left and right door panels are in the open position.

21 Claims, 6 Drawing Sheets

FIRE TRUCK HOSE BED COVER AND PERSONNEL SAFETY BARRIER

FIELD

The present disclosure relates to the field of firefighting equipment, and in particular to a fire truck hose bed cover and personnel safety barrier.

BACKGROUND

A fire truck, also known as a fire engine, is a vehicle designed primarily for firefighting operations. The primary purposes of a fire engine include transporting firefighters to an incident scene, providing water with which to fight a fire, and carrying other equipment needed by the firefighters. A typical modern fire truck carries equipment and tools for a wide range of firefighting and rescue tasks, including fire hoses, ladders, self-contained breathing apparatus, ventilating equipment, first aid kits, and hydraulic rescue tools.

A typical fire truck carries a number of different types of fire hoses that serve different roles in putting out a blaze. Some fire engines have a fixed deluge gun, also known as a master stream. An additional feature of a fire engine is preconnected hose lines, commonly referred to as preconnects. The preconnects are attached to the engine's onboard water supply and allow firefighters to quickly mount an aggressive attack on the fire as soon as they arrive on scene. When the onboard water supply runs out, the engine is connected to more permanent sources such as fire hydrants or water tenders and can also use natural sources such as rivers or reservoirs by drafting water. Fire trucks also typically carry 1,000 feet of a 5-inch-diameter hose stored in the hose bed on top of the truck that is used to hook up to fire hydrants. The National Fire Protection Association (NFPA) 1901 apparatus standard requires all hose loads are secured with covers.

DETAILED DESCRIPTION

Figure 1:
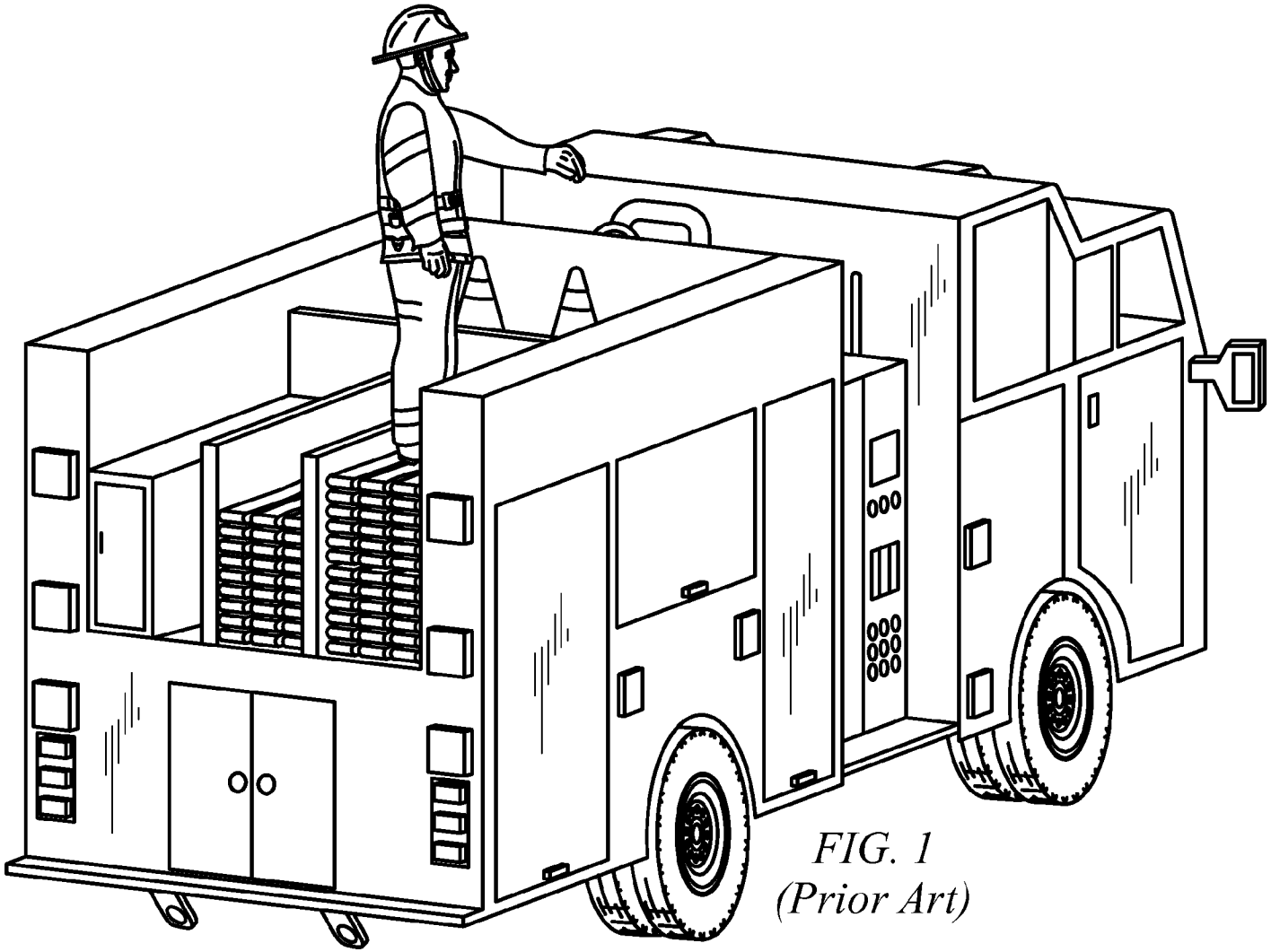
FIG. 1 (Prior Art)
FIG. 1 is a perspective view of a prior art fire truck that lacks a hose bed covering.

FIG. 1 is a perspective view of a prior art fire truck that lacks a hose bed covering. Because unsecured hoses carried in a hose bed that is open on any side has the potential of being accidentally deployed while the fire truck is in motion, the National Fire Protection Association (NFPA) 1901 apparatus standard requires that all hose loads are secured with covers. Accidental deployment of loose hoses while the fire truck is in transit is extremely dangerous. Conventional hose bed covers typically incorporate a piece of tarp, mesh, or netting material that is secured over the top and side openings of the hose bed.

A firefighter may often have to step up into the hose bed to deploy or pack away the fire hose, as well as other firefighting equipment that are stored in the hose bed. It may be seen from FIG. 1 that when a firefighter is standing on the stacked firehoses in the hose bed at the rear of the fire truck, there is no safety railing or barrier at the sides and rear of the truck that can prevent accidental falls and the resultant injury.

Figure 2:
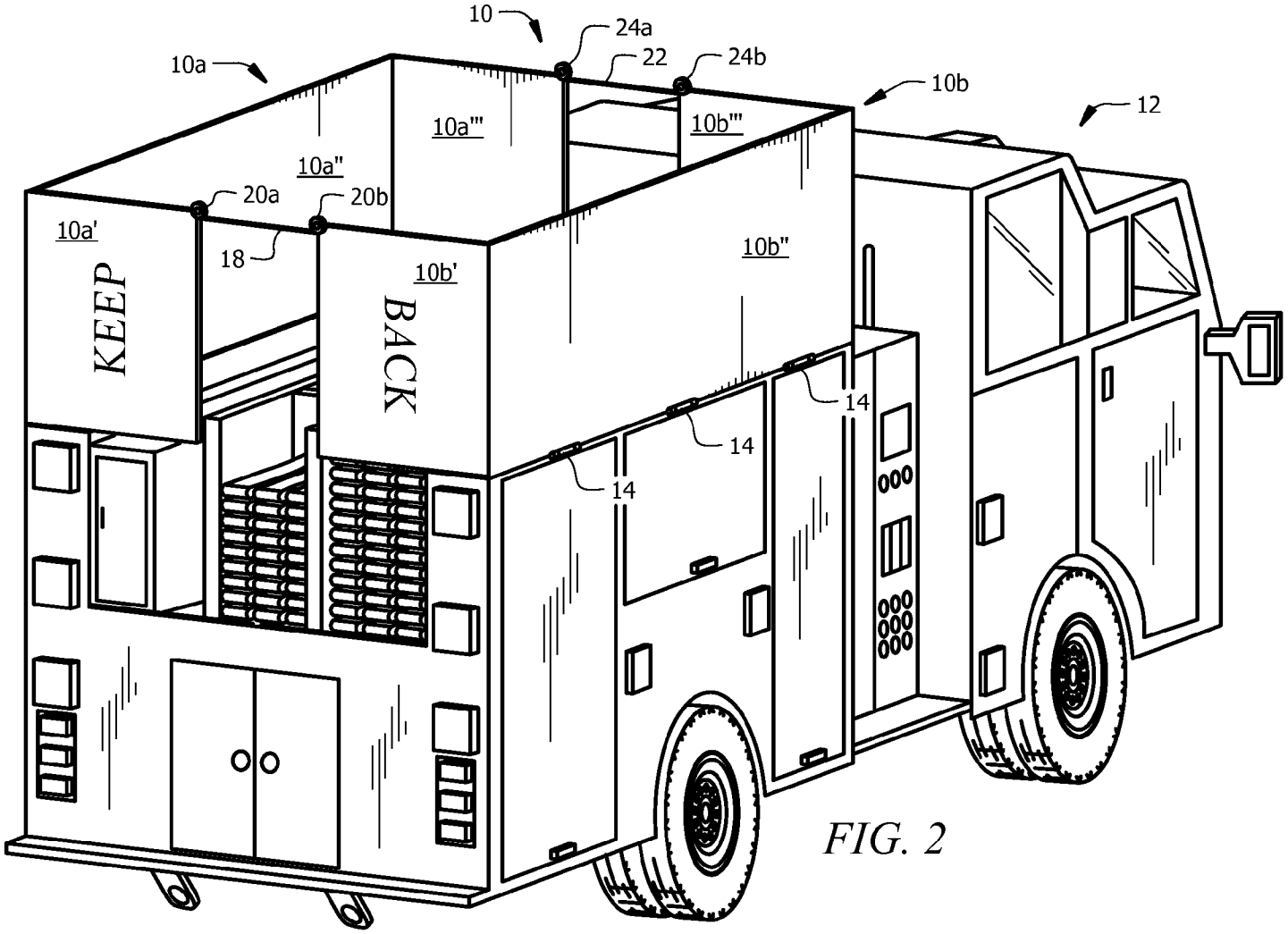
FIG. 2 is a perspective view of a first exemplary embodiment of a fire truck hose bed cover and personnel safety barrier in the open position according to the teachings of the present disclosure.
Figure 3:
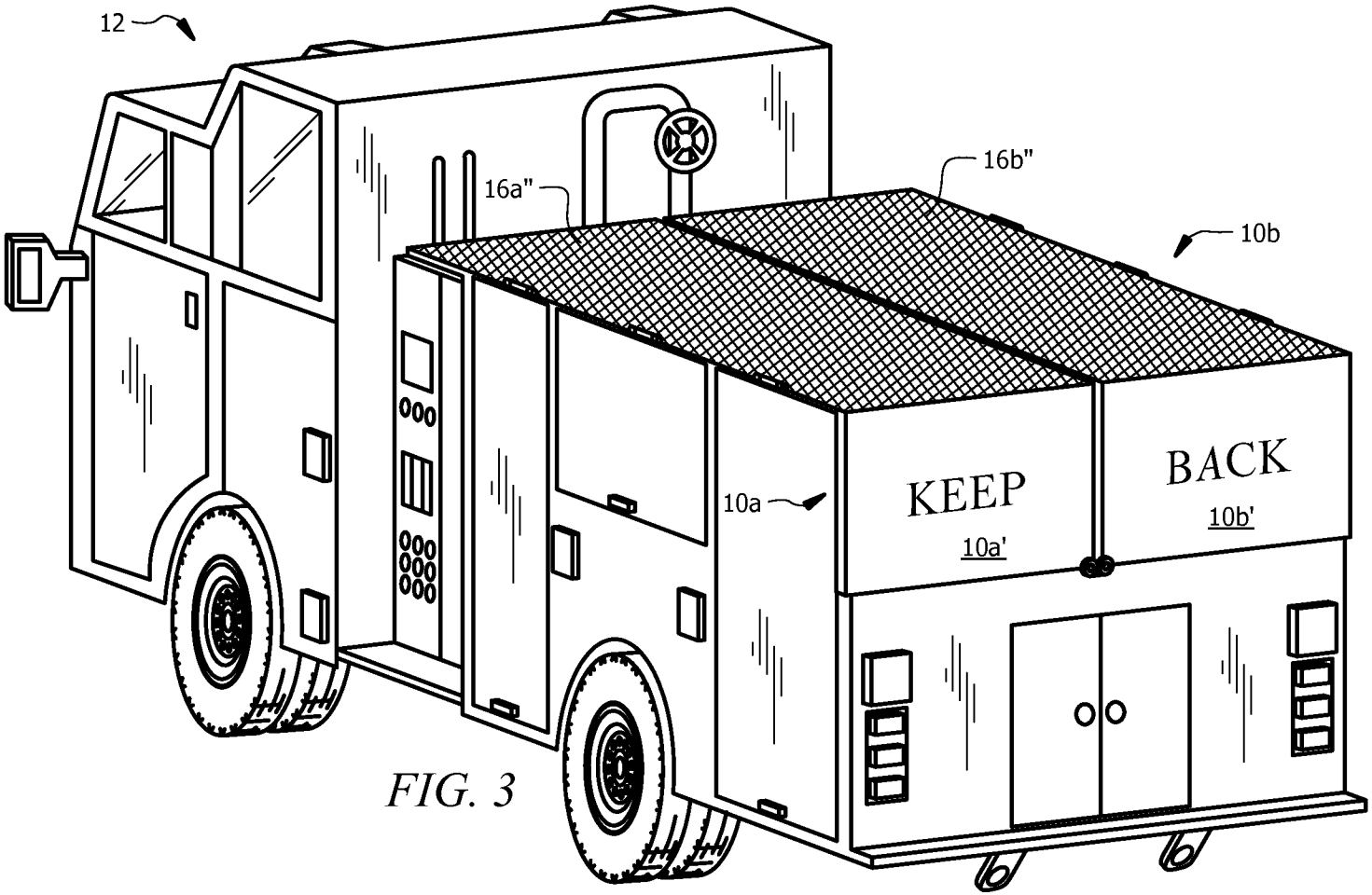
FIG. 3 is a perspective view of a first exemplary embodiment of a fire truck hose bed cover and personnel safety barrier in the closed position according to the teachings of the present disclosure.

FIG. 2 is a perspective view of a first exemplary embodiment of a fire truck hose bed cover and personnel safety barrier 10 in the open position according to the teachings of the present disclosure. The hose bed cover and personnel safety barrier 10 includes at least two (left and right) doors 10*a* and 10*b* that are rotatively coupled to the hose bed frame of a fire truck 12 by hinges 14 or like devices. FIG. 3 shows the hose bed cover and personnel safety barrier 10 in the closed position. It may be seen that doors 10*a* and 10*b* are U-shaped to cover the front, top, and rear openings to the hose bed. In particular, the door 10*a* includes a rear panel 10*a*', a top panel 10*a*", and a front panel 10*a*'"; and the door 10*b* includes a rear panel 10*b*', a top panel 10*b*", and a front panel 10*b*'". In an alternate embodiment, doors 10*a* and 10*b* may be L-shaped for those hose beds that do not have an opening in the front. In this alternate embodiment, door 10*a* includes rear panel 10*a*' and top panel 10*a*", and door 10*b* includes rear panel 10*b*' and top panel 10*b*". The doors may include a latch to keep them shut while the fire truck is in transit.

The door panels 10*a* and 10*b* may be constructed from a wide range of materials, including rigid materials such as metal (e.g., aluminum, stainless steel, steel alloys, metal composites), carbon fiber reinforced polymers, composite materials, etc. Alternatively, doors 10*a* and 10*b* may include a rigid framework with a flexible material (e.g., tarp, canvas, plastic sheeting) secured and stretched over the framework, as shown in FIG. 3 as an example, where the rear panels 10*a*' and 10*b*' are constructed from a rigid solid material and the top panels 16*a*" and 16*b*" are constructed from a mesh material secured and stretched over a rigid frame. The door panels 10*a* and 10*b* may be secured shut using hook and loop closure, straps, bolts, latch, and other conventional means.

The doors 10*a* and 10*b* are further connected via a first cable 18 wound around locking retractable reels 20*a* and 20*b*, and a second cable 22 wound around locking retractable reels 24*a* and 24*b*. When the doors 10*a* and 10*b* are open, the cables 18 and 22 are automatically let out by the reels 20*a*, 20*b*, 24*a*, and 24*b* to stretch across the top of the doors, forming a taut safety railing or barrier for any firefighting personnel that may be positioned in the hose bed. When the doors 10*a* and 10*b* are closed, the cables 18 and 22 are automatically shortened and retracted around the reels 20*a*, 20*b*, 24*a*, and 24*b*, as shown in FIG. 3. It should be noted that the cables 18 and 22 may be constructed of a braided metal, plastics, vinyl-coated wires, a rope made from woven or braided synthetic or natural fibers, a chain, and other suitable construction and materials. It is also contemplated that in one embodiment the cable may connect the two door panels without the use of the retractable reels.

In this embodiment, a short length of slack cable would hang from the door panels when the door is closed.

In an alternate embodiment, door panels 10*a*' and 10*b*' may be made from sheets of a flexible material, e.g., tarp, canvas, plastic sheeting. In this embodiment, the locking retractable reels 20*a* and 20*b* are located on door panels 10*a*" and 10*b*". When the doors are closed, the flexible sheets hang vertically over the opening of the hose bed and may be secured using hook and loop closure and straps, for example.

Figure 4:
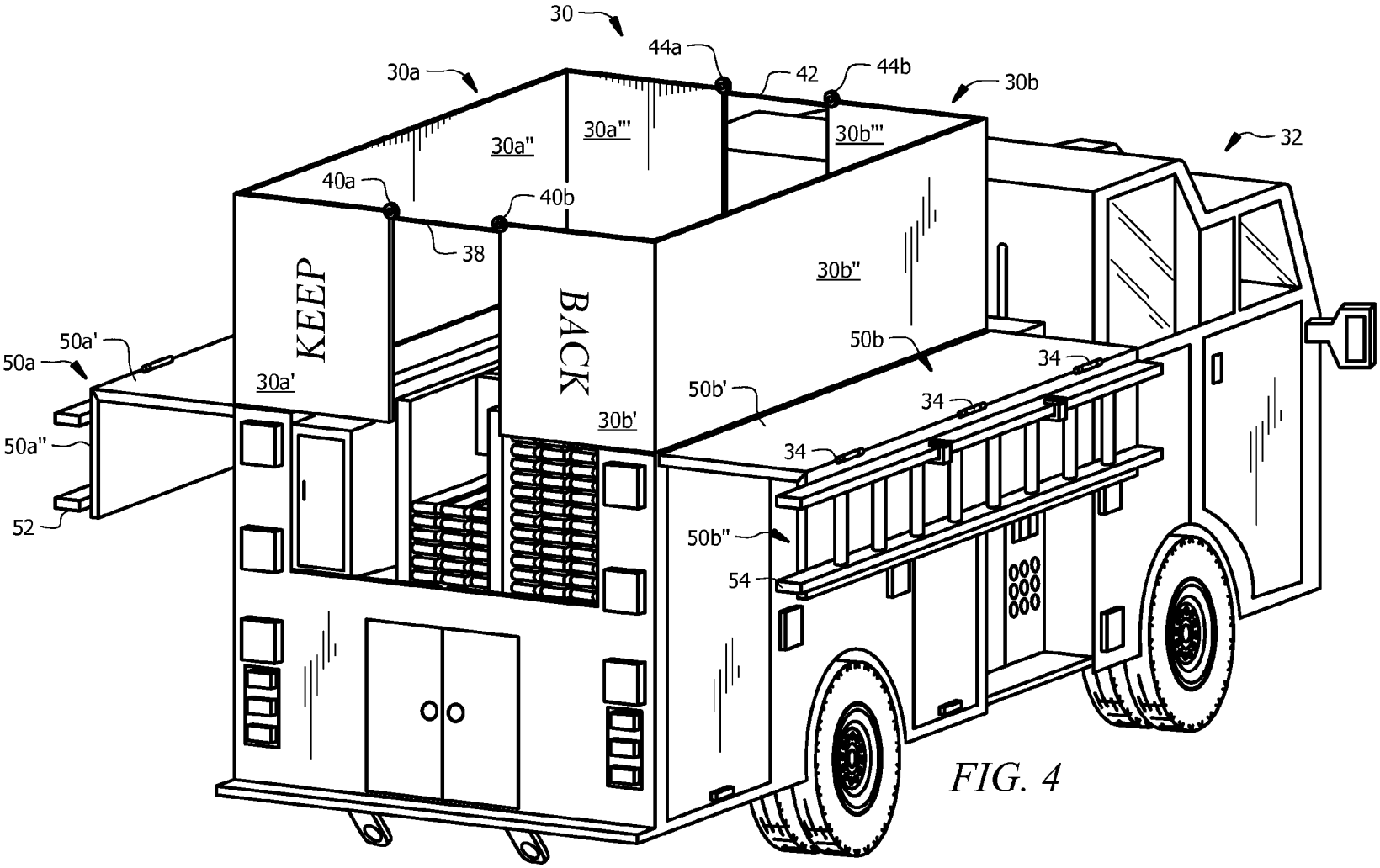
FIG. 4 is a perspective view of a second exemplary embodiment of a fire truck hose bed cover and personnel safety barrier with equipment shelves in the open position according to the teachings of the present disclosure.
Figure 5:
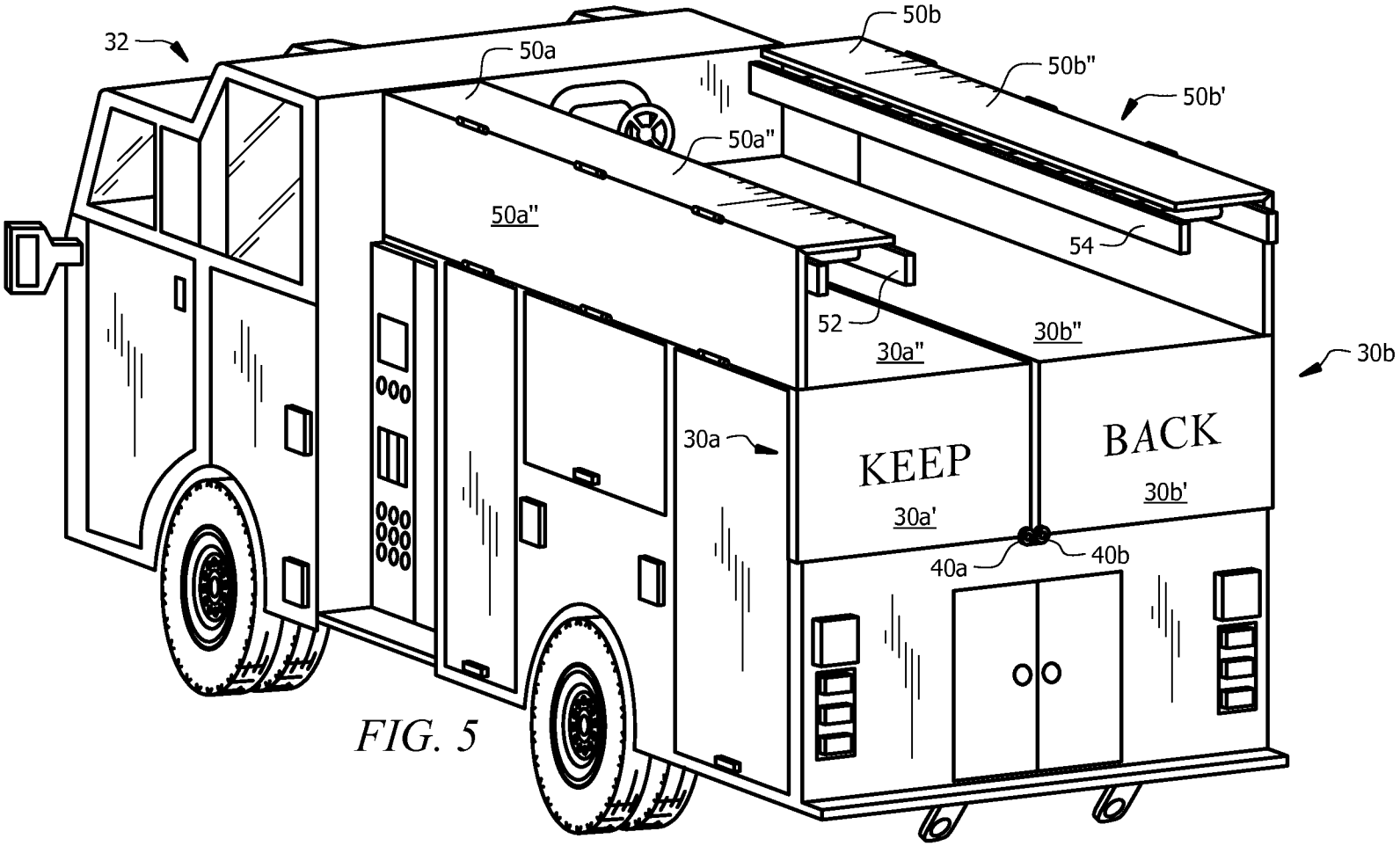
FIG. 5 is a perspective view of a second exemplary embodiment of a fire truck hose bed cover and personnel safety barrier with equipment shelves in the closed position according to the teachings of the present disclosure.

FIGS. 4 and 5 are perspective views of a second exemplary embodiment of a fire truck hose bed cover and personnel safety barrier in the open and closed positions according to the teachings of the present disclosure. The hose bed cover and personnel safety barrier 30 includes at least two doors 30*a* and 30*b* that are rotatively coupled to the hose bed frame of a fire truck 32 by hinges 34 or like devices. FIG. 5 shows the hose bed cover and personnel safety barrier 30 in the closed position. It may be seen that doors 30*a* and 30*b* are U-shaped to cover the front, top, and rear openings to the hose bed. In particular, the door 30*a* includes a rear panel 30*a*', a top panel 30*a*", and a front panel 30*a*'"; and the door 30*b* includes a rear panel 30*b*', a top panel 30*b*", and a front panel 30*b*'". In an alternate embodiment, doors 30*a* and 30*b* may be L-shaped for those hose beds that do not have an opening in the front. In this alternate embodiment, door 30*a* includes rear panel 30*a*' and top panel 30*a*", and door 30*b* includes rear panel 30*b*' and top panel 30*b*".

Similar to the first embodiment, the doors 30*a* and 30*b* are further connected via a first cable 38 wound around locking retractable reels 40*a* and 40*b*, and a second cable 42 wound around locking retractable reels 44*a* and 44*b*. When the doors 30*a* and 30*b* are open, the cables 38 and 42 are automatically let out by the reels 40*a*, 40*b*, 44*a*, and 44*b* to stretch across the top of the doors, forming a safety railing or barrier for any firefighting personnel that may be positioned in the hose bed. When the doors 30*a* and 30*b* are closed, the cables 38 and 42 are automatically shortened and retracted around the reels 40*a*, 40*b*, 44*a*, and 44*b*, as shown in FIG. 4. In an alternate embodiment, door panels 30*a*' and 30*b*' may be made from sheets of a flexible material, e.g., tarp, canvas, plastic sheeting. In this embodiment, the locking retractable reels 40*a* and 40*b* are located on door panels 30*a*" and 30*b*". When the doors are closed, the flexible sheets hang vertically over the opening of the hose bed and may be secured using hook and loop closure and straps, for example.

Again, the door panels 30*a* and 30*b* also may be constructed from a wide range of materials, including rigid materials such as metal (e.g., aluminum, stainless steel, steel alloys, metal composites), carbon fiber reinforced polymers, composite materials, etc. Alternatively, doors 30*a* and 30*b* may include a rigid framework with a flexible material secured and stretched over the framework, where one or more door panels are constructed from a mesh material secured and stretched over a rigid frame. The door panels 30*a* and 30*b* may be secured shut using hook and loop closure, straps, bolts, latch, and other conventional means.

Still referring to FIGS. 4 and 5, the second embodiment further includes equipment shelves 50*a* and 50*b* coupled to doors 30*a* and 30*b*, respectively. The equipment shelves 50*a* and 50*b* are constructed of hinged shelf panels 50*a*', 50*a*" and 50*b*', 50*b*". When the doors 30*a* and 30*b* are closed (FIG. 5), the equipment shelves 50*a* and 50*b* fold over the top of the door panels 30*a*" and 30*b*". In this closed position, the shelf panels 50*a*' and 50*b*' are oriented vertically while the shelf panels 50*a*" and 50*b*" are oriented horizontally. In the open position (FIG. 4), the shelf panels 50*a*' and 50*b*' unfold and become oriented horizontally while the shelf panels 50*a*" and 50*b*" become oriented vertically. In this open position, the tools and equipment 52 and 54 (e.g., ladder, hydraulic rescue tools, axes, and fire extinguishers) securely attached to the shelf panels 50*a*" and 50*b*" become easily accessible and reachable by a firefighter standing next to the fire truck. In the open position, the shelf panels 50*a*" and 50*b*" are extended spaced apart from any compartment located on the truck to enable easy access to the contents therein. The shelf panels may be constructed from a wide range of rigid materials, including, e.g., metal (e.g., aluminum, stainless steel, steel alloys, metal composites), carbon fiber reinforced polymers, composite materials, etc.

Figure 6:
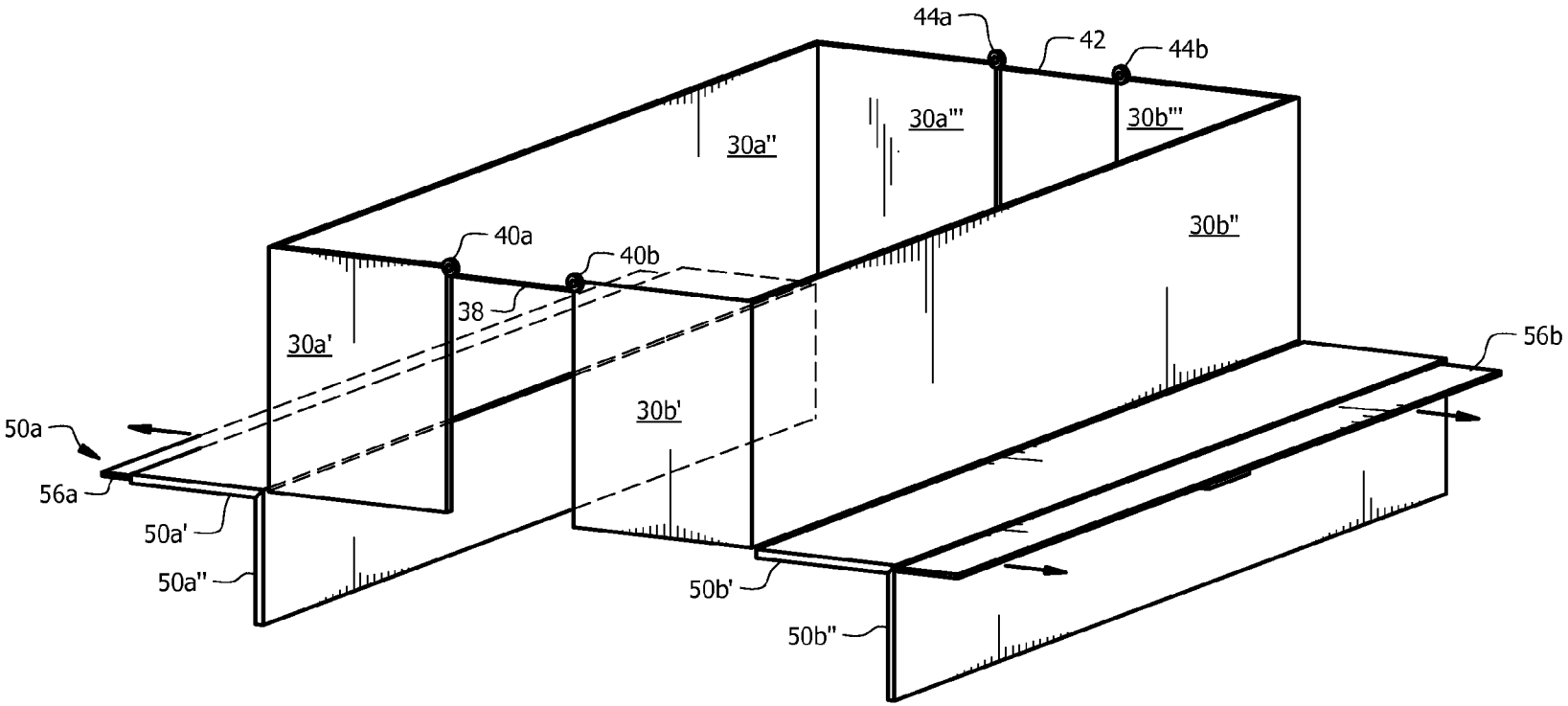
FIG. 6 is a partial perspective view of a third exemplary embodiment of a fire truck hose bed cover and personnel safety barrier with extendable equipment shelves in the open position according to the teachings of the present disclosure.

FIG. 6 is a partial perspective view of a third exemplary embodiment of a fire truck hose bed cover and personnel safety barrier with extendable equipment shelves 56*a* and 56*b* according to the teachings of the present disclosure. In this embodiment, the equipment shelf panels 50*a*' and 50*b*' incorporate extendable ledges 56*a* and 56*b*, respectively. When the door panels 30*a* and 30*b* are in the open position, and the equipment shelves 50*a* and 50*b* are in the open position, the ledges 56*a* and 56*b* may be pulled out to form an integrated horizontal work surface with the shelf panels 50*a*' and 50*b*', respectively. This work surface may serve as temporary surface upon which tools may be placed, for example.

Although not shown explicitly, doors 30*a* and 30*b* as well as equipment shelves 50*a* and 50*b* may be spring-loaded to assist opening and closing actions. Further, these panels may be opened and closed using an electrically actuated hydraulic assembly, so that these actions may be initiated by a switch or button disposed inside the fire truck cab.

It should be noted that one embodiment of the hose bed cover may include more than two doors, such as door panel 10*a*, for example, be composed of two smaller door panels, similar to a dutch door construction. Additionally, the door panels may be constructed using a bifold or multi-fold door construction, where each door panel may have at least two sections. This multi-panel construction may be opened completely so that the panels form a vertical barrier around the hose bed, but may be folded over to lower the overall height of the fire truck and vertical barrier so that access to the hose bed is still be available in fire station garages that may have lower ceilings.

The features of the present invention which are believed to be novel are set forth below with particularity in the appended claims. However, modifications, variations, and changes to the exemplary embodiments described above will be apparent to those skilled in the art, and the fire truck hose bed cover and personnel safety barrier described herein thus encompasses such modifications, variations, and changes and are not limited to the specific embodiments described herein.

What is claimed is:

1. A cover and personnel safety barrier for a fire truck hose bed of a fire truck, comprising:

left and right door panels each coupled to the hose bed by at least one rotatable connector and configured to cover openings to the hose bed in the closed position;

left and right retractable reels coupled to the left and right door panels, respectively; and a cable connecting the left and right locking retractable reels to form a safety barrier over the hose bed when the left and right door panels are in the open position, and the cable being automatically retracted into the retractable reels when the left and right door panels are in the closed position.

2. The cover and personnel safety barrier of claim 1, further comprising at least one equipment shelf coupled to one of the left and right door panels, wherein the equipment shelf is disposed atop of the door panel when the door panel is in the closed position, and is disposed to one side of the fire truck when the door panel is in the open position.

3. The cover and personnel safety barrier of claim 1, wherein the at least one equipment shelf comprises a first shelf panel rotatably coupled to one of the left and right door panels, and a second shelf panel rotatably coupled to the first shelf panel.

4. The cover and personnel safety barrier of claim 3, wherein the at least one equipment shelf further comprises an extendable shelf coupled to the first shelf panel.

5. The cover and personnel safety barrier of claim 1, wherein at least one of the left and right door panels is U-shaped and configured to cover the front, top, and rear openings of the hose bed.

6. The cover and personnel safety barrier of claim 1, wherein at least one of the left and right door panels is L-shaped and configured to cover the top and rear openings of the hose bed.

7. The cover and personnel safety barrier of claim 1, wherein at least one of the left and right door panels is constructed of a rigid material.

8. The cover and personnel safety barrier of claim 1, wherein at least one of the left and right door panels is constructed of a flexible material.

9. The cover and personnel safety barrier of claim 1, wherein the cable is constructed of a material selected from the group consisting of metal, plastics, synthetic fibers, and natural fibers.

10. The cover and personnel safety barrier of claim 1, wherein at least one of the left and right door panels comprises at least two bifold door sections.

11. The cover and personnel safety barrier of claim 1, further comprising an electrically actuated hydraulic assembly configured to initiate actuation by a switch disposed in a cab of the fire truck.

12. A cover and personnel safety barrier for a hose bed of a fire truck, comprising:

left and right door panels each coupled to the hose bed by at least one rotatable connector and configured to cover openings to the hose bed in the closed position; and a cable connecting the left and right door panels to form a safety barrier over the hose bed when the left and right door panels are in the open position.

13. The cover and personnel safety barrier of claim 12, further comprising left and right locking retractable reels coupled to the left and right door panels, respectively, and the cable being automatically retracted into the reels when the left and right door panels are in the closed position.

14. The cover and personnel safety barrier of claim 12, further comprising at least one equipment shelf coupled to one of the left and right door panels, wherein the equipment shelf is disposed atop of the door panel when the door panel is in the closed position, and is disposed to one side of the fire truck when the door panel is in the open position.

15. The cover and personnel safety barrier of claim 12, wherein the at least one equipment shelf comprises a first shelf panel rotatably coupled to one of the left and right door panels, and a second shelf panel rotatably coupled to the first shelf panel.

16. The cover and personnel safety barrier of claim 15, wherein the at least one equipment shelf further comprises an extendable shelf coupled to the first shelf panel.

17. The cover and personnel safety barrier of claim 12, wherein at least one of the left and right door panels is U-shaped and configured to cover the front, top, and rear openings of the hose bed.

18. The cover and personnel safety barrier of claim 12, wherein at least one of the left and right door panels is L-shaped and configured to cover the top and rear openings of the hose bed.

19. The cover and personnel safety barrier of claim 12, wherein at least one of the left and right door panels is constructed of a rigid material.

20. The cover and personnel safety barrier of claim 12, wherein at least one of the left and right door panels is constructed of a flexible material stretched over a rigid frame.

21. A fire truck, comprising:

an engine;

firefighting apparatus;

a hose compartment configured for storing fire hoses;

left and right door panels each coupled to the hose bed by at least one hinge and configured to cover openings to the hose compartment in the closed position; and a linkage connecting the left and right door panels to form a personnel safety barrier when the left and right door panels are rotated open in the open position.

* * * * *